US011946483B2

(12) United States Patent
Ke et al.

(10) Patent No.: US 11,946,483 B2
(45) Date of Patent: Apr. 2, 2024

(54) FAN

(71) Applicant: Acer Incorporated, New Taipei (TW)

(72) Inventors: Jau-Han Ke, New Taipei (TW); Tsung-Ting Chen, New Taipei (TW); Chun-Chieh Wang, New Taipei (TW); Yu-Ming Lin, New Taipei (TW); Cheng-Wen Hsieh, New Taipei (TW); Wen-Neng Liao, New Taipei (TW)

(73) Assignee: ACER INCORPORATED, New Taipei (TW)

( * ) Notice: Subject to any disclaimer, the term of this patent is extended or adjusted under 35 U.S.C. 154(b) by 0 days.

(21) Appl. No.: 18/318,852

(22) Filed: May 17, 2023

(65) Prior Publication Data

US 2023/0383762 A1 Nov. 30, 2023

(30) Foreign Application Priority Data

May 24, 2022 (TW) ..... 111119215

(51) Int. Cl.

| | |
|---|---|
| ***F04D 29/66*** | (2006.01) |
| ***F04D 17/10*** | (2006.01) |
| ***F04D 29/28*** | (2006.01) |
| ***F04D 29/42*** | (2006.01) |

(52) U.S. Cl.

CPC ..... *F04D 29/281* (2013.01); *F04D 17/10* (2013.01); *F04D 29/4226* (2013.01); *F04D 29/666* (2013.01)

(58) Field of Classification Search

CPC ..... F04D 29/281; F04D 29/666

See application file for complete search history.

(56) References Cited

U.S. PATENT DOCUMENTS

| | | | | |
|---|---|---|---|---|
| 9,169,844 | B2 * | 10/2015 | Lin | F04D 29/162 |
| 10,519,979 | B2 * | 12/2019 | Lin | F04D 29/666 |
| 11,286,954 | B1 * | 3/2022 | Jia | F04D 29/701 |
| 2009/0162210 | A1 * | 6/2009 | Hwang | F04D 29/681 416/95 |
| 2020/0182258 | A1 * | 6/2020 | Lin | F04D 25/0613 |
| 2020/0191157 | A1 * | 6/2020 | Lin | F04D 29/282 |
| 2021/0324873 | A1 * | 10/2021 | Lin | F04D 29/325 |

FOREIGN PATENT DOCUMENTS

| | | | |
|---|---|---|---|
| JP | 2006-70809 | A | 3/2006 |
| TW | I464329 | B | 12/2014 |

OTHER PUBLICATIONS

Chinese language office action dated Dec. 7, 2022, issued in application No. TW 111119215.

* cited by examiner

*Primary Examiner* — Sabbir Hasan

(74) *Attorney, Agent, or Firm* — McClure, Qualey & Rodack, LLP

(57) ABSTRACT

A fan is provided herein, including a housing, a hub, and a plurality of blades. The housing includes a top case and a bottom case. The hub is rotatably disposed between the top case and the bottom case in an axial direction. The blades extend from the hub in a radial direction, located between the top case and the bottom case. Each of the blades has a proximal end and a distal end. The proximal end is connected to the hub. The distal end is opposite from the proximal end, located at the other side of the blade, having at least one recessed portion. Each of the recessed portions form a passage for air.

9 Claims, 4 Drawing Sheets

FAN

CROSS REFERENCE TO RELATED APPLICATIONS

This application claims priority of Taiwan Patent Application No. 111119215, filed on May 24, 2022, the entirety of which is incorporated by reference herein.

BACKGROUND OF THE INVENTION

Field of the Invention

The present disclosure relates to a fan, and more particularly to a fan with blades that have recessed portions.

Description of the Related Art

As technology has developed, electronic devices (such as notebook computers, smartphones, etc.) have become thinner. As a result, there is less space available for cooling assemblies (such as a fan). Therefore, it is important to increase the height of fan blades and thus increase the air flow within a limited volume.

In conventional fans, the tails of the blades (the ends that are away from the hub) are usually flat and parallel to the top case and the bottom case of the fan casing. Also, in order to avoid interference between the blades and the fan casing during rotation, there is usually a gap between each blade and the fan casing. However, when the height of a blade is increased so that the gap becomes smaller, a blade tone is easily generated during operation. Therefore, the present disclosure provides an improved fan, maintaining its cooling function while resolving the noise issue.

BRIEF SUMMARY OF THE INVENTION

A fan is provided in the present disclosure, including a housing, a hub, and a plurality of blades. The housing includes a top case and a bottom case. The hub is rotatably disposed between the top case and the bottom case in an axial direction. The blades extend from the hub in a radial direction, located between the top case and the bottom case. Each of the blades has a proximal end and a distal end. The proximal end is connected to the hub. The distal end is opposite from the proximal end, located at the other side of the blade, having at least one recessed portion. Each of the recessed portions form a passage for air.

In some embodiments of the present disclosure, each of the blades further includes a top surface facing the top case and a bottom surface facing and parallel to the bottom case, wherein the recessed portions are located at the top surface.

In some embodiments of the present disclosure, each of the blades further includes a top surface facing the top case and a bottom surface facing and parallel to the bottom case, wherein the recessed portions are located at the top surface and at the bottom surface.

In some embodiments of the present disclosure, each of the passages for air formed by the recessed portions has an air entrance and an air exit. The air entrance and the air exit are aligned in a direction that is substantially perpendicular to the radial direction and the axial direction.

In some embodiments of the present disclosure, the at least one recessed portion includes a first recessed portion, a second recessed portion, and a third recessed portion. The first recessed portion forms a first passage for air, and has a first air entrance and a first air exit that are aligned in a first direction. The second recessed portion forms a second passage for air, and has a second air entrance and a second air exit that are aligned in a second direction. The third recessed portion forms a third passage for air, and has a third air entrance and a third air exit that are aligned in a third direction. The first direction, the second direction, and the third direction are all different.

In some embodiments of the present disclosure, the first direction, the second direction, and the third direction are all perpendicular to the axial direction but not perpendicular to the radial direction.

In some embodiments of the present disclosure, in each of the blades, the size of the proximal end along the axial direction is less than the size of the distal end along the axial direction.

In some embodiments of the present disclosure, each of the blades is substantially in an S shape when viewed along the axial direction.

In some embodiments of the present disclosure, each of the blades is made of plastic materials using injection molding.

In some embodiments of the present disclosure, each of the blades is made of metallic materials using a stamping technique.

DETAILED DESCRIPTION OF THE INVENTION

The fan of the embodiments of the present disclosure is described below. However, it is readily known that various suitable creative concepts are provided by embodiments of the present disclosure that can be implemented in a wide variety of specific fields. The specific embodiments disclosed herein are merely illustrative for describing specific ways of utilizing the present disclosure, and are not intended to limit the scope of the present disclosure.

Unless otherwise defined, all terms (including technical and scientific terms) used herein have the same meaning as commonly understood by one of ordinary skill in the art. Furthermore, terms, such as those defined in commonly used dictionaries, should be interpreted as having a meaning that is consistent with their meaning in the context of the relevant art, and will not be interpreted in an idealized or overly formal sense unless expressly so defined herein.

In the following detailed description of the preferred embodiments, reference is made to the accompanying drawings, and in which specific embodiments of which the disclosure may be practiced are shown by way of illustration. In this regard, directional terminology, such as "top," "bottom," "left," "right," "front," "back," etc., is used with reference to the orientation of the figures being described. The components of the present disclosure can be positioned in a number of different orientations. As such, the directional terminology is used for the purposes of illustration and is in no way limiting.

Figure 1:
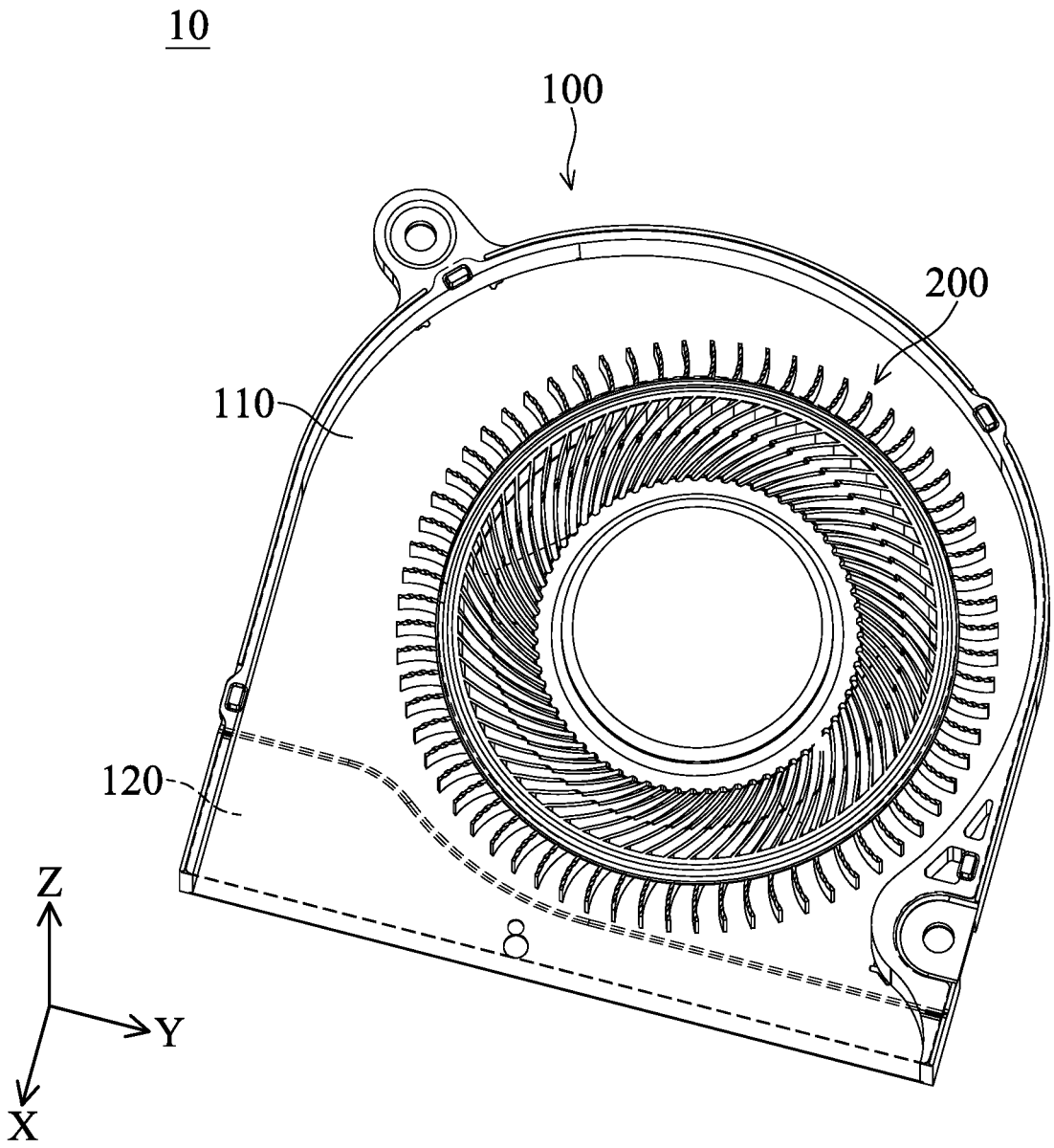
FIG. 1 is a perspective view of the fan, according to some embodiments of the present disclosure.

Firstly, referring to FIG. 1, FIG. 1 is a perspective view of the fan 10, according to some embodiments of the present disclosure. As shown in FIG. 1, the fan 10 mainly includes a housing 100 and a fan body 200. In some embodiments, the housing 100 includes a bottom case 110 and a top case 120. In FIG. 1, the bottom case 110 and the top case 120 are disposed parallel to each other along Z direction. The entire fan body 200 is disposed between the bottom case 110 and the top case 120. That is, the fan body 200 is disposed within the housing 100.

Figure 2:
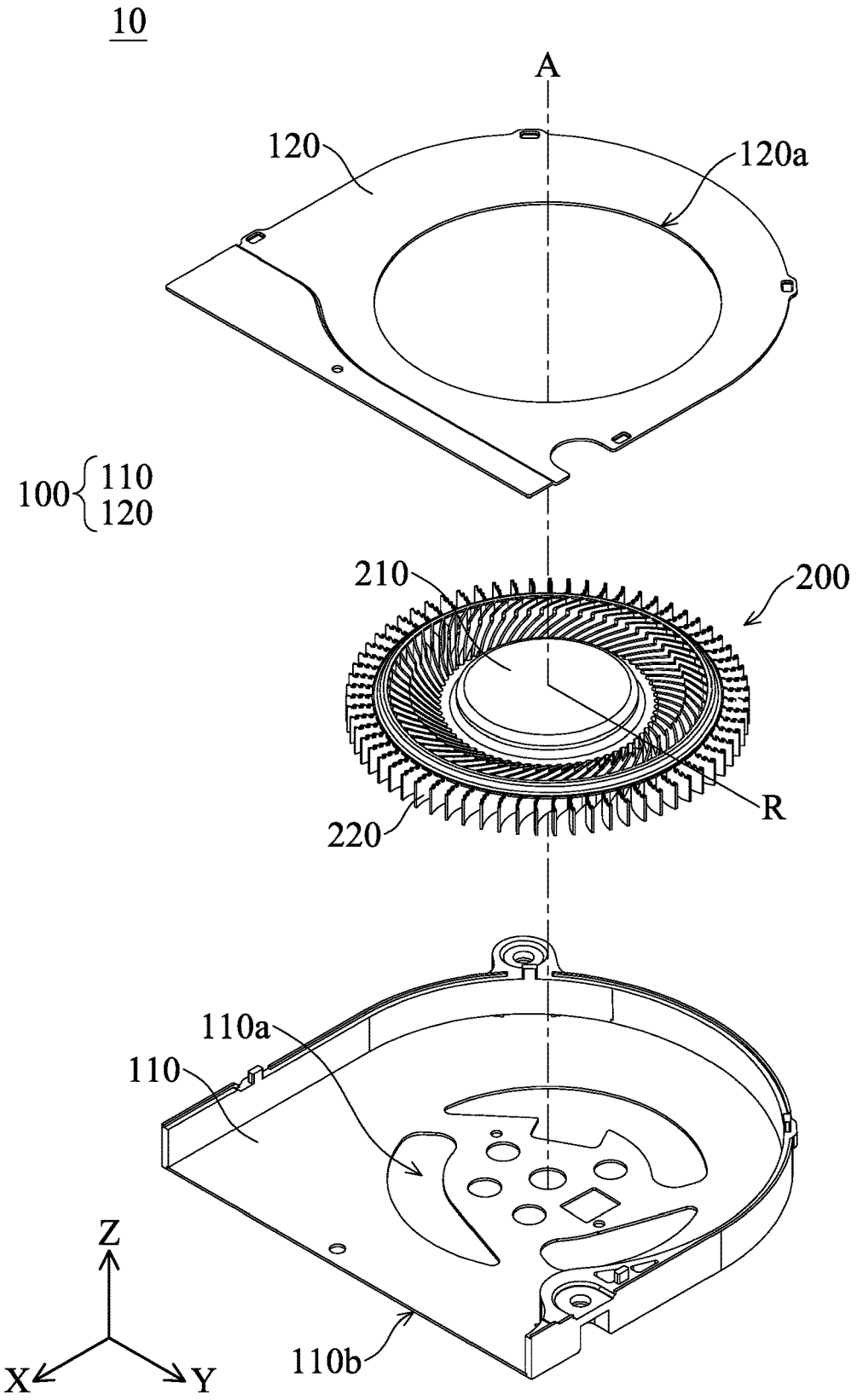
FIG. 2 is an exploded view of the fan, according to some embodiments of the present disclosure.

Next, referring to FIG. 2, FIG. 2 is an exploded view of the fan 10, according to some embodiments of the present disclosure. As shown in FIG. 2, a bottom opening 110*a* and an air blow opening 110*b* are formed on the bottom case 110, and a top opening 120*a* is formed on the top case 120. In some embodiments, air may enter the housing 100 through the bottom opening 110*a* and the top opening 120*a*, passing through the fan body 200 inside, generating air flow. The air flow may leave the housing 100 through the air blow opening 110*b*. In some embodiment, the bottom opening 110*a* may include one or more holes with different sizes and shapes, which may be adjusted based on user requirements, and not limited to the types disclosed herein.

As shown in FIG. 2, the fan body 200 includes a hub 210 and a plurality of blades 220. In the axial direction A, the hub 210 is rotatably disposed between the top case 120 and the bottom case 110. The blades 220 extend outward along the radial direction R from the hub 210. The blades 220 are also located between the top case 120 and the bottom case 110. It should be noted that the number of blades 220 illustrated in FIG. 2 is merely an example. In other embodiments, the fan body 200 may include more or less blades 220.

Figure 3:
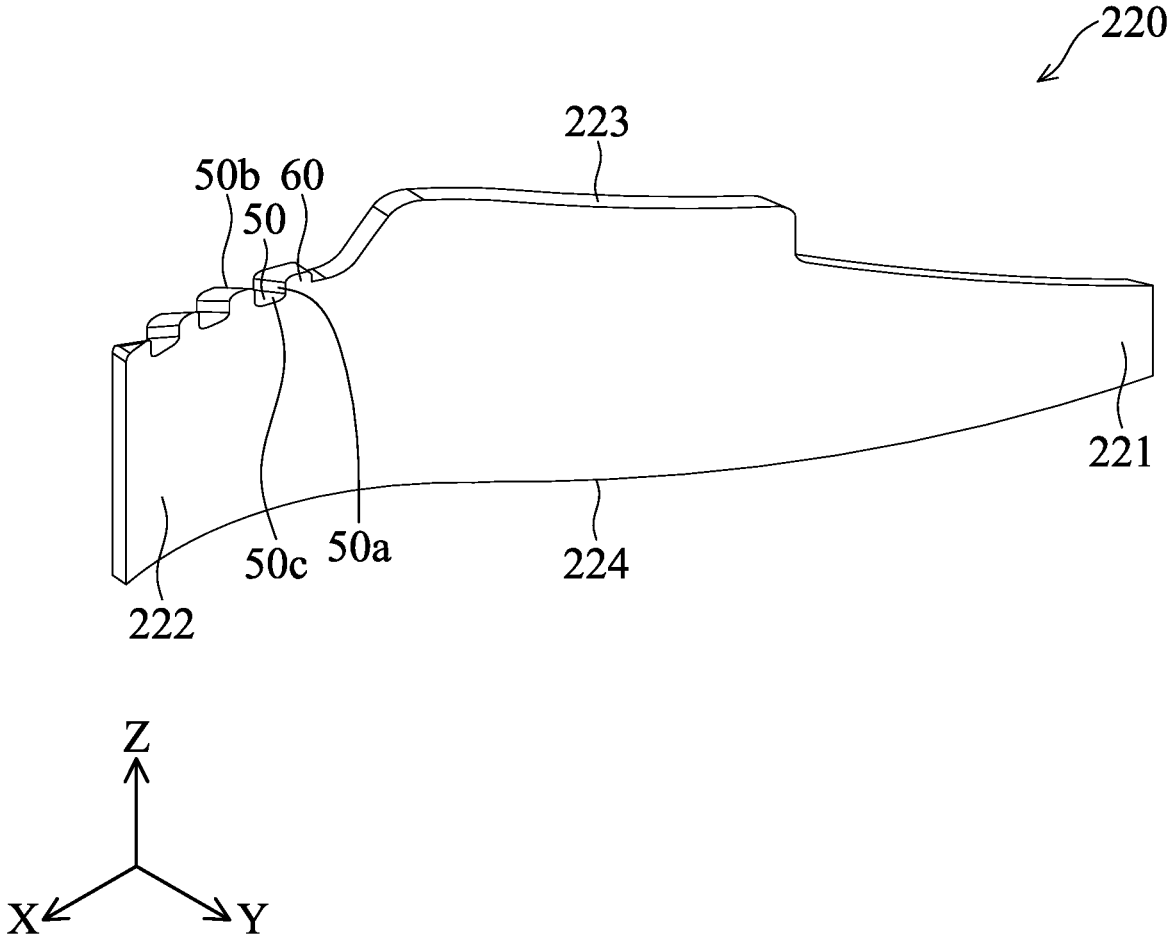
FIG. 3 is a perspective view of a single blade, according to some embodiments of the present disclosure.
Figure 4:
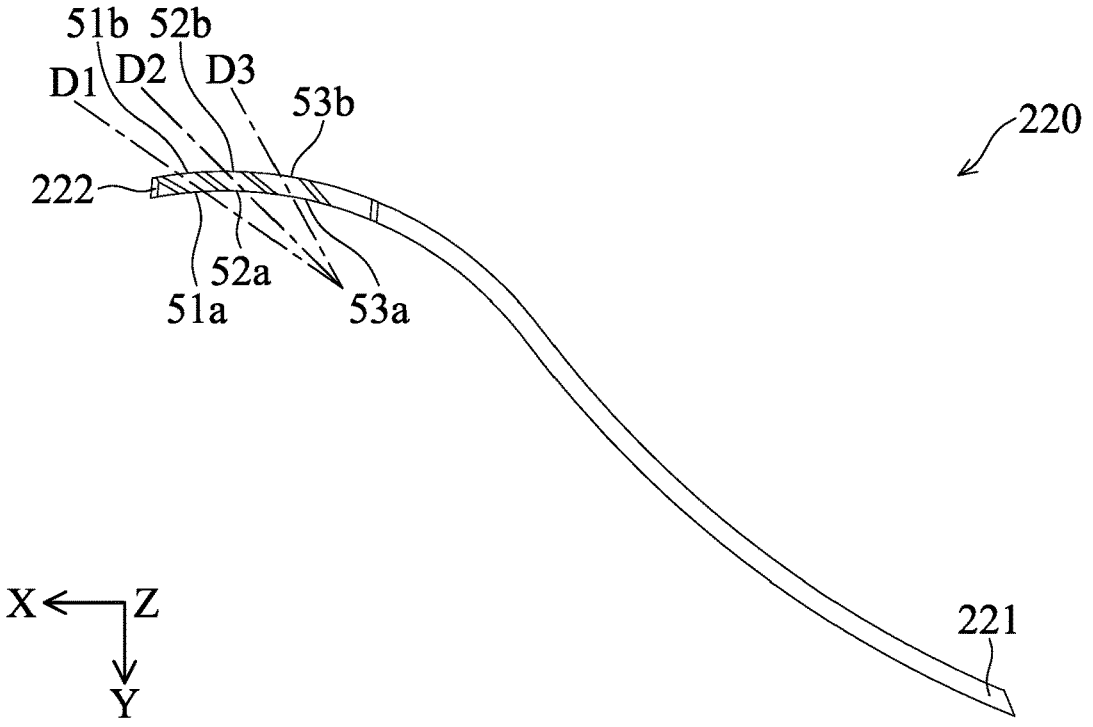
FIG. 4 is a top view of a single blade, according to some embodiments of the present disclosure.
Figure 5:
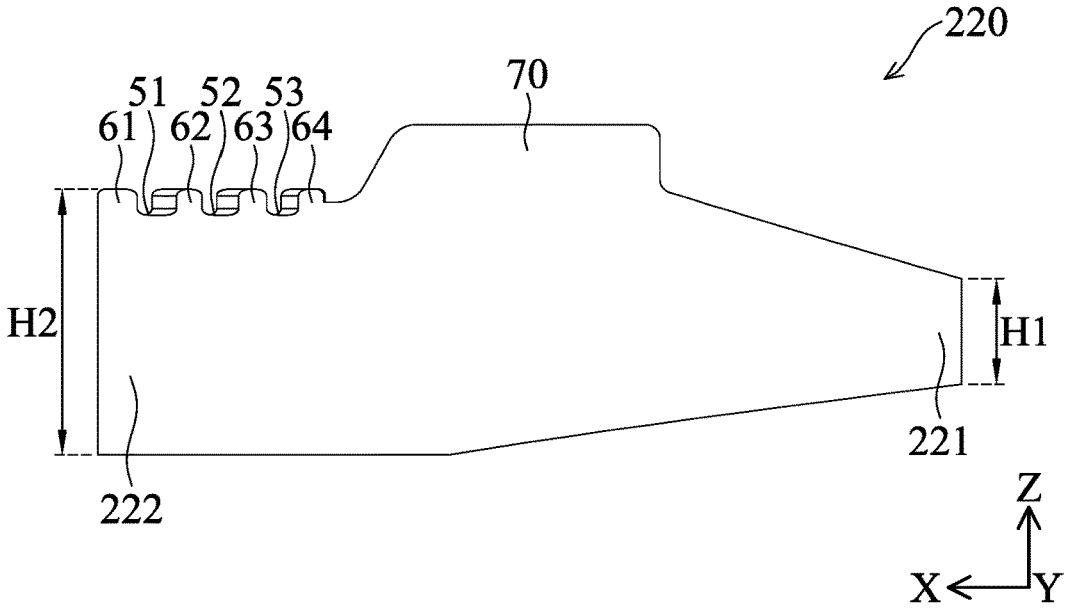
FIG. 5 is a front view of a single blade, according to some embodiments of the present disclosure.

Next, referring to FIGS. 3-5, FIGS. 3-5 are respectively a perspective view, a top view, and a front view of a single blade 220, according to some embodiments of the present disclosure. In some embodiments, each of the blades 220 is made of plastic materials using injection molding. In other embodiments, each of the blades 220 is made of metallic materials using a stamping technique. As shown in FIG. 3, each of the blades 220 includes a proximal end 221 and a distal end 222. The proximal end 221 may be connected to the hub 210 using any suitable connecting methods. The distal end 222 is opposite from the proximal end 221, located at the other side of the blade 220, and having at least one recessed portion 50. Each of the recessed portions 50 may form a passage for air, providing a space for air to flow. The detailed structure of the recessed portions will be described below. Each of the blades 220 further includes a top surface 223 and a bottom surface 224. The top surface 223 faces the top case 120 of the housing 100, and the bottom surface 224 faces the bottom case 110 of the housing 100. In some embodiments, the bottom surface 224 is disposed parallel to the bottom case 110. In some embodiments, since the blades 220 have raised structures (such as the upper raised portion 70 shown in FIG. 5), the top surface 223 is not parallel to the top case 120. However, in other embodiments, the top surface 223 may be disposed parallel to the top case 120.

In some embodiments, the recessed portions 50 that are located at the distal end 222 are all disposed at the top surface 223, as shown in FIG. 3. In some other embodiments, the recessed portions 50 that are located at the distal end 222 may be partially disposed at the top surface 223 and partially disposed at the bottom surface 224. Of course, in yet some other embodiments, the recessed portions 50 that are located at the distal end 222 may all be disposed at the bottom surface 224. It should be noted that, no matter the recessed portions 50 are located at the top surface 223 and/or the bottom surface 224, they all serve as passages for air. Air flows through the recessed portions 50, which increases air turbulence.

In every recessed portion 50, the recessed portion 50 includes a sidewall 50*a*, a sidewall 50*b*, and a base surface 50*c*. In the embodiment shown in FIG. 3, the sidewall 50*a* and the sidewall 50*b* face each other. The base surface 50*c* connects the sidewall 50*a* with the sidewall 50*b*. In some embodiments, the connected corners between the base surface 50*c* and the sidewall 50*a* and between the base surface 50*c* and the sidewall 50*b* may be rounded, so that the shape of the passage for air is substantially a U shape. In other embodiments, the connected corners between the base surface 50*c* and the sidewall 50*a* and between the base surface 50*c* and the sidewall 50*b* may be in right angles, so that the shape of the passage for air is substantially a three-sided rectangular shape.

Referring to FIGS. 4 and 5, the blades 220 illustrated in FIGS. 4 and 5 has three recessed portions 50: a first recessed portion 51, a second recessed portion 52, and a third recessed portion 53, and four raised portions 60: a first raised portions 61, a second raised portions 62, a third raised portions 63, and a fourth raised portions 64. Each of the recessed portions 50 are located between two of the raised portions 60. In the embodiments illustrated herein, the top surfaces of the raised portions 60 are higher than the top surface 223, and the base surfaces 50*c* (see FIG. 3) of the recessed portions 50 are lower than the top surface 223. However, in some other embodiments, the top surfaces of the raised portions 60 or the base surfaces 50*c* of the recessed portions 50 may be at the same height as the top surface 223. It should be noted that the number of the recessed portions 50 and the raised portions 60 are not limited to the embodiments shown herein. The blades 220 may have any suitable number of the recessed portions 50 and the raised portions 60, for example, two recessed portions 50 and three raised portions 60, or four recessed portions 50 and five raised portions 60, etc.

As shown in FIG. 4, the passages for air formed by each of the recessed portions all have an air entrance and an air exit that are aligned in a direction that is substantially perpendicular to the radial direction R (i.e. the direction connecting the hub 210 and the distal end 222, such as X direction) and the axial direction A (Z direction). The air enters the passage for air from the air entrance, and leaves the passage for air from the air exit. For example, the first recessed portion 51 forms a first passage for air, and has a first air entrance 51*a* and a first air exit 51*b* that are aligned in a first direction D1; the second recessed portion 52 forms a second passage for air, and has a second air entrance 52*a* and a second air exit 52*b* that are aligned in a second direction D2; the third recessed portion 53 forms a third passage for air, and has a third air entrance 53*a* and a third air exit 53*b* that are aligned in a third direction D3. As shown in FIG. 4, the first direction D1, the second direction D2, and the third direction D3 are all different. In other words, the angle between the first direction D1 and the radial direction R, the angle between the second direction D2 and the radial direction R, and the angle between the third direction D3 and the radial direction R are all different. As a result, air that goes through the first passage for air, the second passage for air, and the third passage for air forms multiple air flows in different direction, further increasing air turbulence, so that the noise issue of the fan may be improved.

Furthermore, in some embodiments, the angle between the first direction D1 and the radial direction R, the angle between the second direction D2 and the radial direction R, and the angle between the third direction D3 and the radial direction R are all greater than 90 degrees. That is, the first direction D1, the second direction D2, and the third direction D3 are all perpendicular to the axial direction (Z direction) but not perpendicular to the radial direction R. More specifically, in the embodiment shown in FIG. 4, the angle between the first direction D1 and the radial direction R is greater than the angle between the second direction D2 and the radial direction R, and the angle between the second direction D2 and the radial direction R is greater than the angle between the third direction D3 and the radial direction R. In other embodiments, the smallest angle among the angle between the first direction D1 and the radial direction R, the angle between the second direction D2 and the radial direction R, and the angle between the third direction D3 and the radial direction R may be 90 degrees. In addition, in some embodiment, the first direction D1, the second direction D2, and the third direction D3 may be the same. For example, the angle between the first direction D1 and the radial direction R, the angle between the second direction D2 and the radial direction R, and the angle between the third direction D3 and the radial direction R may all be 90 degrees. That is, the first direction D1, the second direction D2, and the third direction D3 are all perpendicular to the axial direction (Z direction) and also perpendicular to the radial direction R. The angles between the passages for air and the radial direction R may be determined and arranged based on the curvature of the blades 220 themselves. Each of the passages for air may include the same or different angle. It is not limited to the embodiments disclosed herein.

In some embodiments, each of the blades 220 has a first height H1 along the axial direction A (Z direction) at the proximal end 221, and has a second height H2 along the axial direction A at the distal end 222. As shown in FIG. 5, the first height H1 is smaller than the second height H2. Through a greater second height H2, the blade 220 may generate a greater air flow within a limited volume, increasing the airflow rate, thereby improving the cooling effects.

Referring to FIGS. 3-5, when viewed along the axial direction A, each of the blades 220 disclosed herein is substantially in an S shape. In detail, divided by the upper raised portion 70, the portion of the blade 220 that is closer to the proximal end 221 and the portion that is closer to the distal end 222 may bend in different directions. The bending directions may be determined by the shape or the structure required by the fan 10, and are not limited to the formation disclosed herein. As mentioned above, each of the blades may be made using an injection molding or stamping technique. A one-piece blade 220 has the advantage of guiding the air flow smoothly, which is helpful for reducing the noise of the fan 10.

In summary, the fan body 200 of the fan 10 has a plurality of one-piece blades 220. At the distal end 222 of each blades 220, there is at least one recessed portions 50. Each of the recessed portions 50 forms a passage for air, allowing air to pass through, thereby generating air turbulence of different directions other than the initial air flow generated by the fan 10. Through this air turbulence, noise caused by the operation of the fan 10 may be reduced, thereby improving the sound quality. Additionally, the disposal of the recessed portions 50 does not increase the volume of the blades 220, so that the blades 220 may generate the largest airflow rate within a limited volume, which is advantageous for its cooling effect and lower noise. Compared with conventional fans, the fans disclosed herein has lower noise when the rotation speed are the same as the conventional ones, or generates greater airflow rate when the noise level are the same as the conventional ones.

Although embodiments of the present disclosure and their advantages have been described in detail, it should be understood that various changes, substitutions and alterations can be made herein without departing from the spirit and scope of the disclosure as defined by the appended claims. Moreover, the scope of the present application is not intended to be limited to the particular embodiments of the process, machine, manufacture, and composition of matter, means, methods and steps described in the specification. As one of ordinary skill in the art will readily appreciate from the disclosure of the present disclosure, processes, machines, manufacture, compositions of matter, means, methods, or steps, presently existing or later to be developed, that perform substantially the same function or achieve substantially the same result as the corresponding embodiments described herein may be utilized according to the present disclosure. Accordingly, the appended claims are intended to include within their scope of such processes, machines, manufacture, and compositions of matter, means, methods, or steps. In addition, each claim constitutes a separate embodiment, and the combination of various claims and embodiments are within the scope of the disclosure.

Although embodiments of the present disclosure have been provided with preferred embodiments, they are not intended to be limiting the present disclosure. Changes and alterations can be made herein without departing from the spirit and scope of the disclosure by anyone of ordinary skill in the art. Therefore, the true scope of the disclosed embodiments is indicated by the following claims and their equivalents.

What is claimed is:

1. A fan, comprising:

a housing, comprising a top case and a bottom case;

a hub, rotatably disposed between the top case and the bottom case in an axial direction; and a plurality of blades, extending from the hub in a radial direction, and located between the top case and the bottom case, wherein each of the blades includes:

a proximal end connected to the hub; and a distal end that is opposite from the proximal end, located at the other side of the blade, and having recessed portions, wherein each of the recessed portions forms a passage for air;

wherein the recessed portions include:

a first recessed portion, forming a first passage for air, having a first air entrance and a first air exit that are aligned in a first direction; and a second recessed portion, forming a second passage for air, having a second air entrance and a second air exit that are aligned in a second direction;

wherein the first direction and the second direction are different.

2. The fan as claimed in claim 1, wherein each of the blades further includes a top surface facing the top case and a bottom surface facing and parallel to the bottom case, wherein the recessed portions are located at the top surface.

3. The fan as claimed in claim 1, wherein each of the passages for air formed by the recessed portions has an air entrance and an air exit, wherein the air entrance and the air exit are aligned in a direction that is perpendicular to the radial direction and the axial direction.

4. The fan as claimed in claim 1, wherein the at least one recessed portions further include:

a third recessed portion, forming a third passage for air, having a third air entrance and a third air exit that are aligned in a third direction;

wherein the first direction, the second direction, and the third direction are all different.

5. The fan as claimed in claim 4, wherein the first direction, the second direction, and the third direction are all perpendicular to the axial direction but not perpendicular to the radial direction.

6. The fan as claimed in claim 1, wherein in each of the blades, the size of the proximal end along the axial direction is less than the size of the distal end along the axial direction.

7. The fan as claimed in claim 1, wherein each of the blades is in an S shape when viewed along the axial direction.

8. The fan as claimed in claim 1, wherein each of the blades is made of plastic materials using injection molding.

9. The fan as claimed in claim 1, wherein each of the blades is made of metallic materials using a stamping technique.

* * * * *